United States Patent [19]

Fushimi et al.

[11] 4,131,492

[45] Dec. 26, 1978

[54] STEEL ARTICLE HAVING A NITRIDED AND PARTLY OXIDIZED SURFACE AND METHOD FOR PRODUCING SAME

[75] Inventors: Shingi Fushimi, Yokosuka; Takeshi Miyata, Yokohama, both of Japan

[73] Assignee: Nissan Motor Company, Ltd., Japan

[21] Appl. No.: 785,235

[22] Filed: Apr. 6, 1977

[30] Foreign Application Priority Data

Apr. 8, 1976 [JP] Japan ..... 51/38806

[51] Int. Cl.$^2$ ..... C23C 11/16

[52] U.S. Cl. ..... 148/16.6; 148/31.5

[58] Field of Search ..... 148/16.6, 31.5, 16.5

[56] References Cited

U.S. PATENT DOCUMENTS

| | | | |
|---|---|---|---|
| 2,513,302 | 7/1950 | Felid | 148/31.5 |
| 3,748,195 | 7/1973 | Kondo et al. | 148/16.6 X |
| 3,802,933 | 4/1974 | Rausch et al. | 148/31.5 |
| 3,943,010 | 3/1976 | Hartline | 148/16.6 X |
| 4,017,336 | 1/1976 | Fordulis | 148/31.5 |

FOREIGN PATENT DOCUMENTS

| | | | |
|---|---|---|---|
| 2508907 | 9/1975 | Fed. Rep. of Germany | 148/16.6 |

OTHER PUBLICATIONS

Floe, C. F., "Heat Treating and Forging" Nov. 1943, pp. 587–590.

*Primary Examiner*—G. O. Peters

[57] ABSTRACT

Surface-hardening of a steel article which is to be mated with a separate article so as to make a sliding or rolling face-to-face contact is accomplished by heating the steel article in ammonia gas containing from 1 to 10% by volume of air. The treated article has an oxidized layer as an outmost part of a nitride layer. The oxidized layer abrades more readily than the nitride layer, so that the article has the property of smoothly fitting a separate article practically from the start of use and exhibits a good wear resistance during subsequent use.

5 Claims, 7 Drawing Figures

STEEL ARTICLE HAVING A NITRIDED AND PARTLY OXIDIZED SURFACE AND METHOD FOR PRODUCING SAME

BACKGROUND OF THE INVENTION

This invention relates generally to nitriding of steel articles, and more particularly to a steel article which is to be mated with a separate article so as to make a sliding or rolling face-to-face contact and an improved nitriding method for the production of the same.

Hardening of a surface region of steel articles can be achieved by diffusing nitrogen into the surface region at elevated temperature. This process is familiar under the term of nitriding. In principle, nitriding is a strain hardening of steel attributable to the formation of stable compounds (nitrides). The usual source of active nitrogen for nitriding is ammonia gas. At the nitriding temperature, at least part of the ammonia gas decomposes at the surface of the steel, liberating active nitrogen. The liberated nitrogen permeates and diffuses into the steel, so that the steel is gradually nitrided from the surface.

When nitriding is effected on a steel article which is to be mated with a separate article in a manner to make a sliding or rolling face-to-face contact, there is a problem that the nitrided article has rather a poor property of smoothly fitting the mated article, particularly during an initial stage of use, whether the mating takes the form of a rubbing contact as in the case of bushings or a meshing contact as in gears.

SUMMARY OF THE INVENTION

It is an object of the present invention to provide a steel article which is to be melted with a separate article so as to make a sliding or rolling face-to-face contact and has a good wear resistance together with a good property of smoothly fitting the mated article from the start of use.

It is another object of the invention to provide an improved nitriding method for the production of the above described steel article.

A steel article according to the invention has a nitride layer which forms a surface region of the article and an oxidized layer which occupies an outermost part of the nitride layer.

In the present application, the nitride layer implies a layer in which metal nitrides are present as the result of nitriding or soft-nitriding of the steel article. It is permissible that the metal nitrides are present in the oxidized layer.

The thickness of the oxidized layer is preferably in the range from about 1 to about 10 μm.

An improved nitriding method according to the invention for the production of the described steel article comprises the step of heating a steel article in an ammonia gas atmosphere containing from 1 to 10% by volume of oxygen. Air can be used to realize the presence of oxygen in the ammonia gas atmosphere. In this case, the amount of air in the ammonia gas is made to be from 5 to 50% by volume.

According to this method, nitriding of the steel article and the oxidation of the surface part of the nitrided region can simultaneously be achieved. This offers a great convenience for industrial application of the method. However, the surface oxidation according to the invention can be accomplished also by subjecting a steel article which has already been nitrided or soft-nitrided in an ammonia atmosphere containing no or less than 1 Vol.% oxygen (or less than 5 Vol.% air) to heating in the above described oxygen-containing ammonia atmosphere.

In this case, the two heating steps may be carried out successively (without cooling the article between the two heating steps) by commencing the addition of oxygen or air to continuously supplied ammonia at the end of the first heating step while the heating is continued. However, it is permissible to perform the two heating steps with an interval therebetween, so that the article is once isolated from ammonia and/or cooled.

The heating in ammonia containing 1–10 Vol.% oxygen (or 5–50% air) is carried out preferably at a temperature in the range from 450 to 650° C.

The oxidized layer formed according to the invention easily abrades out compared with a nitride layer formed by a usual nitriding process. The steel article according to the invention can smoothly fit a separate article practically from the start of use owing to this property of the oxidized layer. Since the abrasion of the oxidized layer causes the exposure of the harder nitride layer, the steel article exhibits a good wear resistance during use.

BRIEF DESCRPTION OF THE DRAWINGS

DESCRIPTION OF PREFERRED EMBODIMENTS

Figure 1:
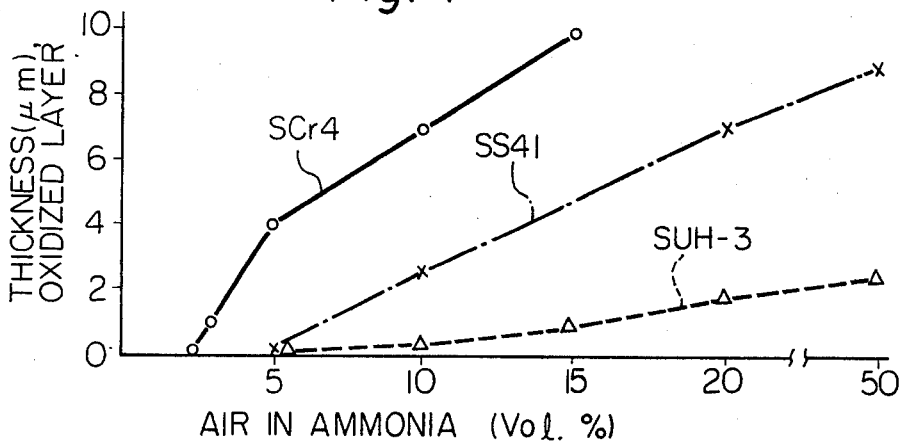
FIG. 1 is a graph showing the dependence of the thickness of an oxidized layer formed in a nitrided steel article on the amount of air present in ammonia for nitriding, experimentally ascertained on three different types of steels.

When nitriding of steel is accomplished using a mixture of ammonia gas and air (or oxygen), an oxidized layer is formed to a certain thickness from the nitrided surface. The thickness of the oxidized layer depends primarily on the amount of air or oxygen added to ammonia. The dependence was experimentally ascertained for various steels. For example, FIG. 1 shows the experimental results on three types of steels, a structural carbon steel, SS41, a chromium steel, SCr4 and a heat resisting steel (nickel-chromium steel), SUH-3, obtained when nitriding (accompanied with surface oxidation) was accomplished at 570° C. for 90 min. As seen, the thickness of the oxidized layer increases almost in direct proportion to the amount of air added to ammonia so long as the amount of air is above a certain level, and it is difficult to form an oxidized layer of a substantial thickness when the amount of air is below this level. The lower boundary of the amount of air in ammonia is set at 5% by volume (this corresponds to 1% by volume in the case of oxygen) in the present invenntion based on these experimental results. The upper boundary is set at 50% by volume for air (10% by volume of oxygen) from the following two reasons. Firstly there is a fear of explosion if air or oxygen is added to ammmonia in a larger amount. Secondly, the decomposition of ammonia is excessively promoted with the generation of a large quantity of steam when more than 50% of air (or more than 10% of oxygen) is present in ammonia, resulting in that the nitrided surface loses smoothness and that the service life of the nitriding furnace is shortened.

Figure 2:
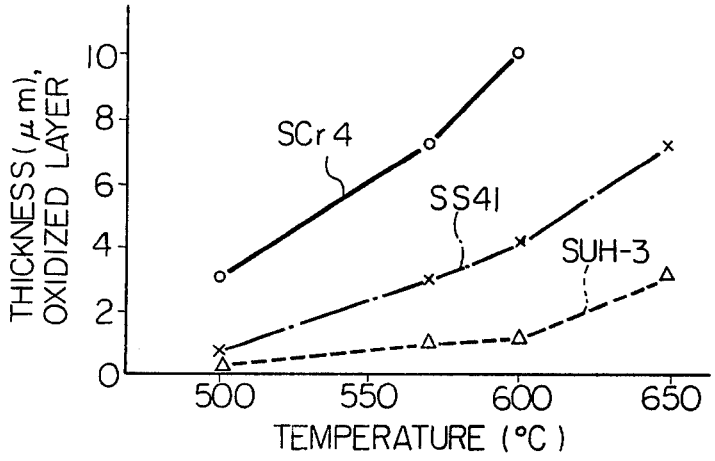
FIG. 2 shows the dependence of the thickness of the oxidized layer on the heating temperature.

The thickness of the oxidized layer depends on the heating condition too. FIG. 2 shows experimental results on the aforementioned three types of steels, obtained by varying the heating temperature while the amount of air in ammonia was constantly maintained at 10 Vol.% and the heating time at 90 min. Under this set of conditions, the oxidized layer can be formed to a suitable thickness with good physical properties by selecting the heating temperature within the range from about 500 to about 650° C. In general, it is undesirable to reduce the heating temperature below 450° C. because neither the oxidized layer nor the nitride layer remaining beneath has a sufficient thickness and, hence, the product does not exhibit a satisfactorily high wear resistance. It is also undesirable to raise the heating temperature above about 650° C. because of a lowering in the hardness of the nitride layer, meaning a lower wear resistance of the product.

Figure 3:
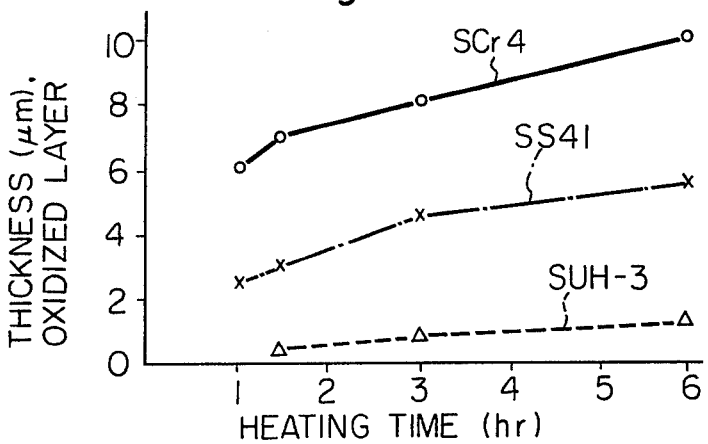
FIG. 3 shows the dependence of the thickness of the oxidized layer on the heating time.

The thickness of the oxidized layer increases as the amount of time for nitriding (and oxidation) is increased. When the aforementioned three types of steels were treated at 570° C. with the addition of 10 Vol.% of air to ammonia, the thickness of the oxidized layers varied with variation in the heating time as shown in FIG. 3.

Accordingly the formation of the oxidized layer can be controlled to give a thickness suitable to afford the treated steel article the property of smoothly fitting a separate article together with a high wear resistance by setting the amount of air or oxygen in ammonia, heating temperature and heating time in various combinations. An optimum thickness of the oxidized layer is usually in the range from about 1 to about 10 μm.

EXAMPLE 1

The steel article subjected to nitriding and oxidation in this example was an automotive transmission gear. Formerly, gears of this use were produced usually from case hardening steels through carburizing, quench hardening and tempering. At present, structural steels having deep hardening properties (for example, a high tensile chromium steel SCr4) are generally used as the material of the internal gears (coupling sleeves) of automotive transmissions and subjected to nitriding by ammonia gas in order to improve the wear resistance of the gears at high speeds. In conventional nitriding processes it is not particularly intended to add air or oxygen to ammonia gas, but sometimes air is present in less than 5 Vol.% of ammonia (meaning the presence of oxygen in less than 1 Vol.% of ammonia).

The internal gear hardened by a conventional nitriding process does not smoothly mesh with external gears of the transmission at the beginning of use due to high hardness of the nitride layer. When a nitrided gear is mated with carburized gears, a smooth gear shift becomes possible only after a smoothing operation (in the form of a bench test, for example) is accomplished for a considerable amount of time. In the case of very high precision gears, a high hardness of the nitride layer sometimes causes the gear surfaces to get scratches, resulting in the difficulty in making gear shift.

An internal gas (coupling sleeve) of SCr4 for an automotive transmission was produced in some quantities and divided into two groups. The gears of a first group were subjected to a conventional nitriding process, in which the gears were heated in ammonia gas at 570° C. for 90 min. In this case the ammonia gas contained 1 Vol.% of air. The gears of a second group were treated at the same temperature for the same amount of time, but 6 Vol.% of air was present in ammonia gas for this group. As a result, an oxidized layer was formed to a thickness of about 4 μm in the surface region of the nitride layer.

Figure 4:
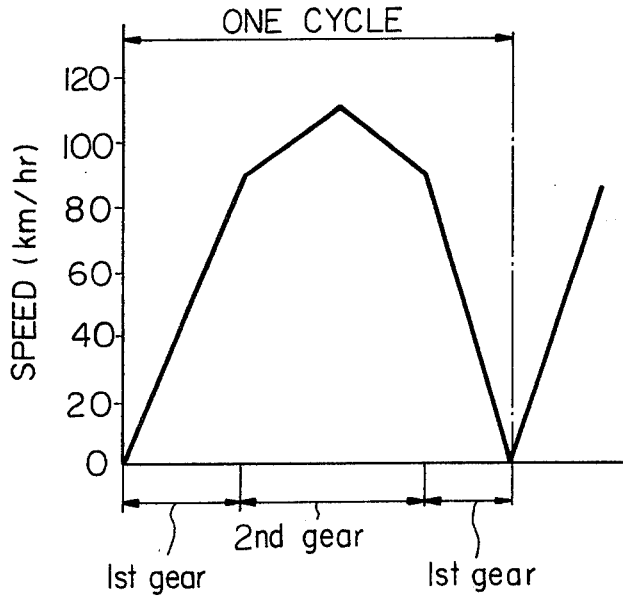
FIG. 4 is a chart showing the program of an endurance running test performed on automotive transmission gears embodying the invention.

The treated gears of the two groups were individually mated with external gears, which were produced through a conventional carburizing process, to constitute a transmission. Each transmission was subjected to a bench test as a smoothing operaton, in which the gear shift and running speed (vehicle speed) were programmed as shown in FIG. 4. For the first group of gears (nitrided by the conventional process), a smooth gear shift was achieved when this operation reached about 50 cycles, but the same was achieved for the second group of gears (treated according to the invention) by performing the smoothing operation only 10 cycles.

Figure 5:
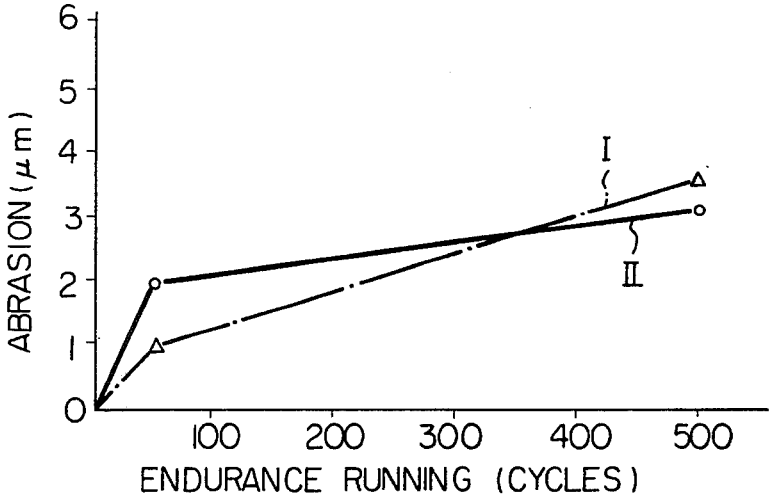
FIG. 5 is a graph showing the result of the aforementioned endurance running test.

Then the bench test (according to the program of FIG. 4) was performed up to 500 cycles as an endurance running test, and the wear of the individual internal gears was examined in terms of the abraded thickness. The result is shown in FIG. 5, wherein the curves I and II represents the first and second groups of internal gears, respectively. The second group of gears exhibited a greater rate of abrasion at an initial stage of use in comparison with the first group of gears which had been nitrided in a conventional manner. However, the second group exhibited a lower abrasion rate during a subsequent steady operation and a less total abrasion at the end of the test than the first group. Such difference in the rate of wear is a proof that the oxidized layer of the first group of gears abrading during the initial stage of use and served for the improvement on the internal gears' property of smoothly fitting the external gears. Throughout the endurance running test, every gear shift on the transmission comprising the second group of gears could very smoothly be accomplished.

When the heat treatment at 570° C. for 90 min. was carried out for the same internal gear with an increase in the amount of air present in ammonia gas to 20 Vol.%, the oxidized layer had a thickness of about 7 μm. The fitting property and wear resistance of this gear was not greatly different from those of the above described second group.

For internal gears of automotive transmissions, it was clarified that the nitriding-and-oxidizing treatment according to the invention is preferably carried out by adding 5–10 Vol.% of air to ammonia gas so that the oxidized layer may be formed to a thickness of about 2–5 μm.

EXAMPLE 2

Figure 6:
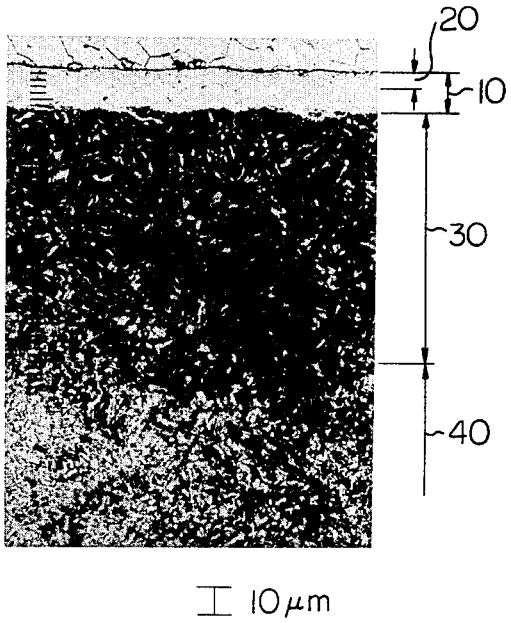
FIGS. 6 and 7 are microphotographs respectively showing the microstructure of two differently nitrided and oxidized steels as examples of the products of a method according to the invention.

A high tensile structural chromium steel, SCr4, was heated in an ammonia gas stream containing 6 Vol.% air at 570° C. for 90 min. FIG. 6 is a 400 magnification microphotograph showing the microstructure of a surface region of the treated steel. A nitride layer 10 was formed to a thickness of about 15 μm from the surface, and an about 5 μm thick oxidized layer 20 occupied a surface region of the nitride layer 10. Reference numeral 30 indicates a diffusion layer and 40 the base material.

EXAMPLE 3

Figure 7:
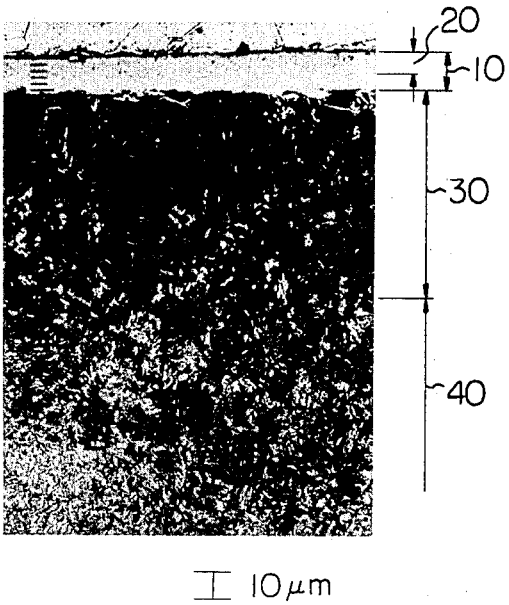

The chromium steel of Example 2 was nitrided by heating in an ammonia gas stream containing 1 Vol.% air at 570° C. for 60 min. Then the amount of air in ammonia was increased to 50 Vol.%, and an additional heating at 570° C. was carried out for 15 min. FIG. 7 is a 400 magnification microphotograph showing the microstructure of a surface region of the thus treated steel. The thickness of the oxidized layer 20 was about 7.5 μm, and the total thickness of the nitride layer 10 (including the oxidized layer 20) was about 15 μm.

What is claimed is:

1. A method of hardening a steel article which is to be mated with a separate article so as to make face-to-face contact, said article having good wear resistance and smoothly fitting the separate article substantially from the start of use, the method comprising:

a. heating said steel article in an ammonia gas atmosphere containing less than 1% by volume of oxygen;

b. continuing heating of the steel article at a temperature of 450 to 650° in an ammonia gas atmosphere containing from 1 to 10% by volume of oxygen so that a surface region of the steel article is nitrided, with the formation of an oxidized layer as an outermost part of the nitrided layer.

2. A method as claimed in claim 1, wherein said ammonia gas atmosphere used in said second ammonia treatment contains from 5 to 50% by volume of air as the source of said oxygen.

3. A method as claimed in claim 1, wherein the two heating steps are performed successively without interrupting the heating and the contact of the steel article with ammonia gas.

4. A method as claimed in claim 1, wherein the two heating steps are preformed with an interval therebetween, so that the steel article is once cooled and isolated from ammonia gas.

5. A method as claimed in claim 1 wherein the heating continues until the oxidized layer is from 1 to 10 μm in depth as measured from the surface of the steel sheet.

* * * * *